US009624707B2

(12) United States Patent
Gipson et al.

(10) Patent No.: US 9,624,707 B2
(45) Date of Patent: Apr. 18, 2017

(54) HEATED SLIDING WINDOW ASSEMBLY

(75) Inventors: Ronnie G. Gipson, Metamora, MI (US); William T. Dufour, Macomb, MI (US)

(73) Assignee: Dura Operating, LLC, Auburn Hills, MI (US)

( * ) Notice: Subject to any disclaimer, the term of this patent is extended or adjusted under 35 U.S.C. 154(b) by 1168 days.

(21) Appl. No.: 12/337,990

(22) Filed: Dec. 18, 2008

(65) Prior Publication Data

US 2010/0154312 A1 Jun. 24, 2010

(51) Int. Cl.
*E05D 15/06* (2006.01)

(52) U.S. Cl.
CPC .... *E05D 15/0621* (2013.01); *E05Y 2800/104* (2013.01); *E05Y 2900/148* (2013.01)

(58) Field of Classification Search
CPC ..... E05D 15/0321; E05D 15/0621; E05Y 2900/148; E05Y 2800/104
USPC ..... 49/380, 404, 413; 219/202, 203, 214, 219/522, 536, 537
See application file for complete search history.

(56) References Cited

U.S. PATENT DOCUMENTS

| | | | | |
|---|---|---|---|---|
| 3,160,736 | A * | 12/1964 | Catterson | A47G 1/02 219/218 |
| 3,263,063 | A * | 7/1966 | Marriott et al. | 219/522 |
| 3,508,361 | A * | 4/1970 | Ryder | 49/70 |
| 3,715,707 | A * | 2/1973 | Anderson | 439/721 |
| 5,441,416 | A * | 8/1995 | Gajewski | H01R 41/00 439/32 |
| 6,014,840 | A | 1/2000 | Ray et al. | |
| 6,544,043 | B1 * | 4/2003 | Smith | H01R 13/2421 219/203 |
| 7,003,916 | B2 * | 2/2006 | Nestell et al. | 49/413 |
| 8,127,498 | B2 * | 3/2012 | Lahnala | 49/413 |
| 2003/0172592 | A1 * | 9/2003 | Krimmel | 49/409 |
| 2004/0020131 | A1 * | 2/2004 | Galer et al. | 49/413 |
| 2006/0283850 | A1 * | 12/2006 | Davey et al. | 219/522 |
| 2008/0185918 | A1 * | 8/2008 | Metz | H01F 38/14 307/104 |
| 2009/0107052 | A1 * | 4/2009 | Dufour et al. | 49/413 |
| 2011/0030276 | A1 * | 2/2011 | Smith et al. | 49/70 |

* cited by examiner

*Primary Examiner* — Gregory Strimbu
(74) *Attorney, Agent, or Firm* — Dinsmore & Shohl LLP

(57) ABSTRACT

A heated sliding window assembly includes at least one fixed window. A rail is attached to the fixed window. A sliding window is moveable along the rail between open and closed positions. The sliding window includes a heater grid and an electrical contact. A conductive member is attached to the at least one fixed window. The conductive member provides electrical coupling between the conductive member and the electrical contact through the entire movement range of the sliding window between the open and closed positions for providing current to the heater grid.

16 Claims, 2 Drawing Sheets

HEATED SLIDING WINDOW ASSEMBLY

FIELD OF THE INVENTION

The invention relates to a sliding vehicle window, and more particularly to a sliding window that is heated for use in a motor vehicle.

BACKGROUND OF THE INVENTION

Motor vehicle window assemblies may include one or more sliding windows that move either in a horizontal or vertical direction. Various sliding window assemblies may be operated manually or driven by an actuator or motor.

For example, sliding window assemblies may be utilized as rear slider windows or backlights for pickup truck type vehicles. In such applications, the window assemblies may be housed within a frame that is positioned in an opening in a back portion of the cab of the pickup. The sliding windows may move horizontally relative to the frame to allow for opening and closing of a portion of the window assembly. Typically, such sliding window assemblies may include one or more fixed windows and a moveable window.

It is desirable to provide the rear backlight or window assembly of a pickup truck with a defrost grid to remove fog or ice from the windows and apply a heating force to melt the ice or snow that may accumulate on the window assembly. In such a heated backlight, wires or other structures may be embedded in the glass which carries an electrical current to heat the glass locally and melt or remove the fog or ice. In such applications, the sliding window may include contacts or electrical elements that are linked with a fixed window to transmit the electrical current for a power source to the various windows of the window assembly. However, such assemblies typically operate in a limited number of positions. For example, current prior art window assemblies may have contacts that transmit electrical current when the sliding window is in a closed position. However, when the sliding window is moved or in an open position the contacts do not provide electrical current to a heater grid of the window. There is therefore a need in the art for a heated sliding window assembly having a heater grid that is operational through the entire movement range of a sliding window between open and closed positions. Additionally, there is a need in the art for a heated sliding window assembly that provides a continuity within an electrical circuit such that additional applications in a vehicle are not lost when a sliding window assembly is moved. There is a further need in the art for a power sliding window assembly in which a continuous electrical current may be provided to various windows within the window assembly throughout the motion of a sliding window of the assembly.

SUMMARY OF THE INVENTION

In one aspect, there is disclosed a heated sliding window assembly that includes at least one fixed window. A rail is attached to the fixed window. A sliding window is moveable along the rail between open and closed positions. The sliding window includes a heater grid and an electrical contact. A conductive member is attached to the at least one fixed window. The conductive member provides electrical coupling between the conductive member and the electrical contact through the entire movement range of the sliding window between the open and closed positions for providing current to the heater grid.

In another aspect, there is disclosed a heated sliding window assembly that includes at least one fixed window. A sliding window is moveable relative to the fixed window. The sliding window includes a heater grid. A conductive member electrically couples the sliding window through the entire movement range of the sliding window between the open and closed positions for providing current to the heater grid.

In a further aspect, there is disclosed a heated sliding window assembly that includes at least one fixed window including a second heater grid. A sliding window is moveable relative to the fixed window. The sliding window is moveable between open and closed positions. The sliding window includes a heater grid. A conductive member electrically couples the sliding window and the at least one fixed window through the entire movement range of the sliding window between the open and closed positions for providing current to the heater grid and the second heater grid.

DETAILED DESCRIPTION OF THE PREFERRED EMBODIMENTS

Figure 1:
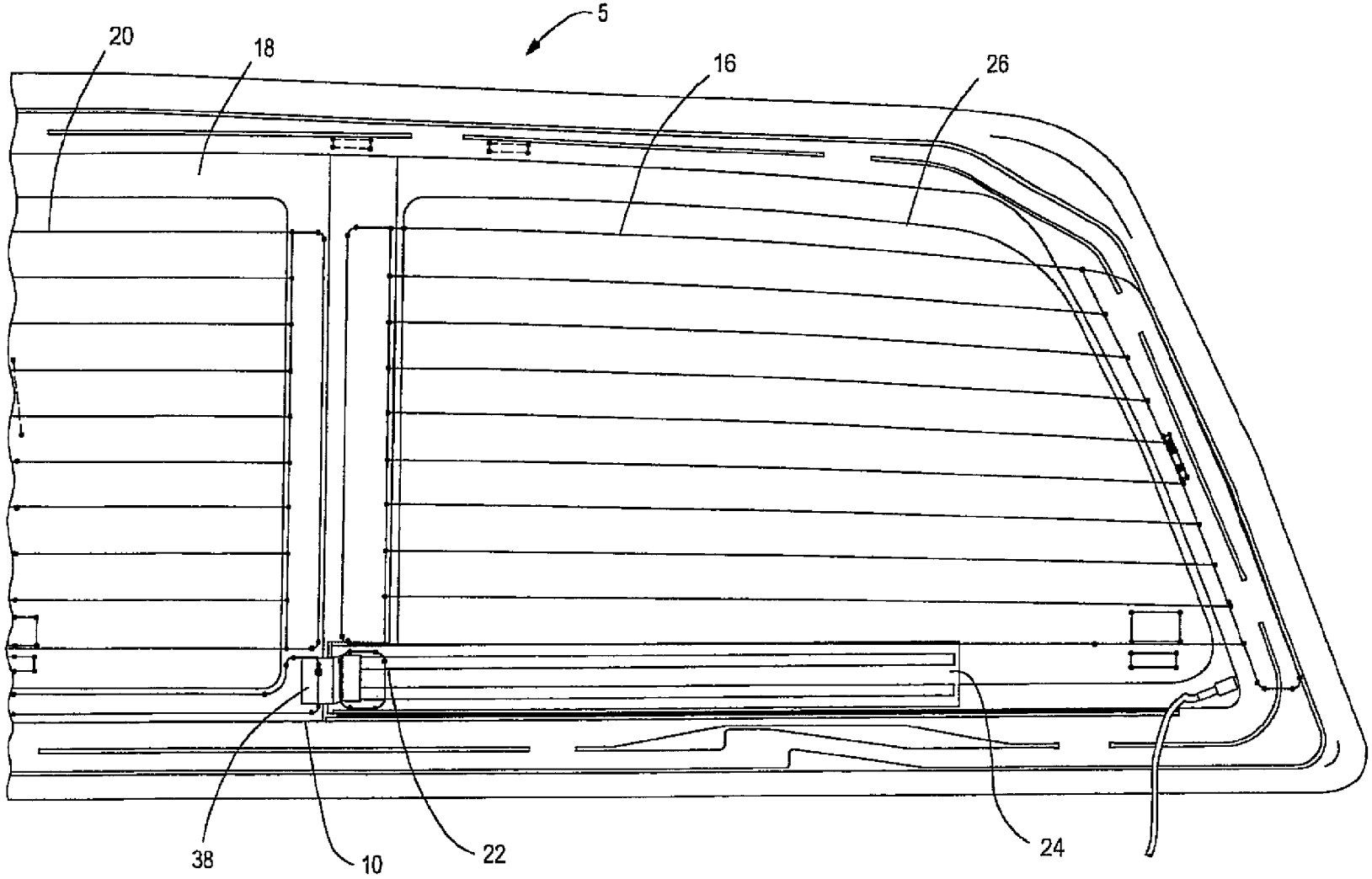
FIG. 1 is a partial front view of a heated sliding window assembly.
Figure 3:
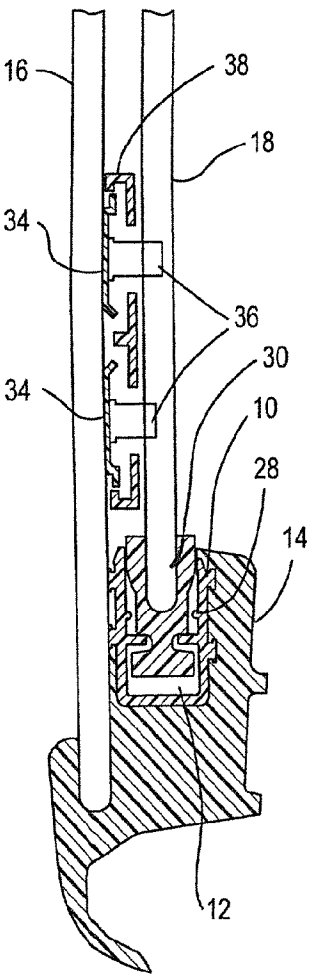
FIG. 3 is a partial sectional view taken along the line 3-3 of FIG. 2 detailing the fixed and sliding windows as well as the electrical contact and conductive member.
Figure 2:
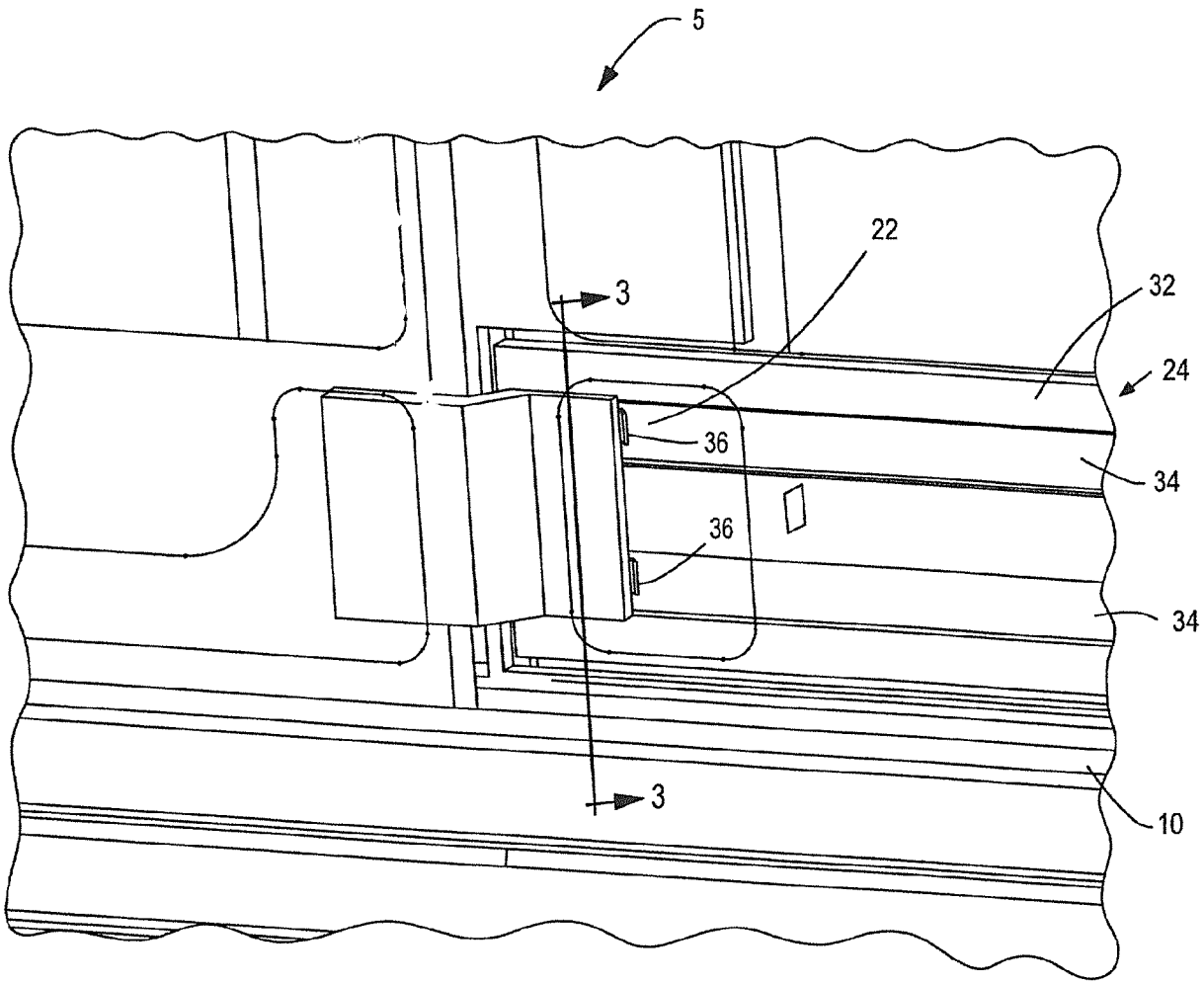
FIG. 2 is a partial perspective view of a heated sliding window assembly including an electrical contact and a conductive member.

Referring to FIGS. 1-3, there is shown a heated sliding window assembly 5. The heated sliding window assembly 5 may include horizontal and vertical applications and may be utilized in various positions on a vehicle. The following detailed description of various embodiments will be given with reference to a heated sliding window assembly 5 positioned in an opening in a back of a motor vehicle. It is to be understood that various other orientations and movements may also be utilized.

The heated sliding window assembly 5 may include a rail 10 that is attached to the vehicle. The rail 10 may include a channel 12 formed therein. The rail 10 may be attached to either an upper or lower portion of a window frame 14 with the rail 10 depicted on the lower portion of a window frame in FIGS. 1-3. The heated sliding window assembly 5 may also include at least one fixed window 16 that is affixed to the vehicle. A sliding window 18 is moveable along the rail 10 between open and closed positions. The sliding window 18 may include a heater grid 20 and an electrical contact 22. A conductive member 24 electrically couples the sliding window 18 through the entire movement range of the sliding window 18 between the open and closed positions for providing current to the heater grid 20.

In one aspect, the at least one fixed window 16 may include a second heater grid 26 in conjunction with the heater grid 20 on the sliding window 18. In one aspect, the heater grid 20 and the second heater grid 26 may be connected in series.

Referring to FIG. 3, the heated sliding window assembly 5 may include a guide bracket 28 that is positioned in the channel 12 formed in the rail 10. The guide bracket 28 may include a slot 30 formed therein that receives the sliding window 18. In this manner, the guide bracket 28 may provide stability for lateral movement of the sliding window 18 within the rail 10.

As stated above, various drive mechanisms may be attached to the sliding window 18 for moving the sliding window 18 between the open and closed positions. For example, drive mechanisms including a pull drive system having cables that apply a pulling force to the sliding window 18 in opposing directions may be utilized. Additionally, various other drive mechanisms such as those disclosed in U.S. Pat. No. 5,724,769; U.S. Pat. No. 5,822,922; U.S. Pat. No. 6,026,611; U.S. Pat. No. 7,437,852 and U.S. Pat. No. 6,766,617 provide various examples of power sliding window assemblies the disclosures of which are herein incorporated by reference in their entirety.

Referring to FIGS. 2 and 3, the conductive member 24 may be attached to the at least one fixed window 16. However, it should be realized that the conductive member 24 may be positioned in alternate locations such as on a frame of the window assembly, within a rail of the window assembly, or the conductive member 24 may be positioned on the sliding window 18 as opposed to the at least one fixed window 16 with corresponding contacts on the at least one fixed window 16. It should be realized that the conductive member 24 may be positioned in various locations to provide electrical coupling between the conductive member 24 and the sliding window 18. In one aspect, the conductive member 24 may include a non-conductive substrate 32 that has a pair of spaced metal strips 34 mounted on the fixed window. The electrical contact 22 of the sliding window 18 may include a pair of leads 36 that are attached to the sliding window 18. The pair of leads 36 may be aligned with the pair of spaced metal strips 34 and contact the spaced metal strips 34 of the conductive member 24. In one aspect, the pair of leads 36 may be electrically connected to the heater grid 20 and the pair of spaced metal strips 34 may also be electrically connected to the second heater grid 26. In this manner, the leads 36 may be soldered or otherwise attached to a portion of the sliding window 18 such that the leads 36 provide electrical connection with the heater grid 20. Additionally, the pair of spaced metal strips 34 may include a portion that is adapted to connect to a bus or other portion of a fixed window 16 such that they are electrically connected to the second heater grid 26.

In one aspect, the heated sliding window 18 assembly may include a cover 38 that is attached to the sliding window 18 that protects the electrical contact 22. The cover 38 may be formed of various materials including plastics and other non-conductive materials. In one aspect, the cover 38 may move in conjunction with the sliding window 18 assembly to provide protection for the electrical contact 22 on the sliding window 18.

In use, the sliding window 18 of the heated sliding window assembly 5 may be moved along the rail 10 between open and closed positions. As the sliding window 18 moves between the closed and open positions the electrical contact 22 of the sliding window 18 is in abutment with the conductive member 24. In this manner, an electrical coupling between the electrical contact 22 and conductive member 24 allows current to pass through an electrical circuit that includes the heater grid 20 of the sliding window 18 and the second heater grid 26 of the at least one fixed window 16. As the sliding window 18 is moved between the open and closed positions, contact is maintained throughout the movement to provide current to the heater grid 20 of the sliding window 18 as well as complete the circuit including the heater grid 20 of the sliding window 18 and the second heater grid 26 of the at least one fixed window 16. In this manner, the electrical circuit may provide continuous current to various portions of the heated sliding window assembly 5. Additionally, other elements included in connection with the heated sliding window assembly 5 may maintain continuity in the circuit upon movement of the sliding window 18. In this manner, a continuous circuit may be provided linking a ground to a source of power for various components included in the electrical circuit.

The invention claimed is:

1. A heated sliding window assembly comprising:

at least one fixed window positioned on a back of a vehicle;

a rail attached to the fixed window;

a sliding window positioned on the back of the vehicle, the sliding window moveable along the rail between open and closed positions, the sliding window including a first heater grid directly attached to a glass of the sliding window and electrical contacts attached to the sliding window;

the at least one fixed window includes a second heater grid attached thereto;

electrically conductive members mounted on the at least one fixed window, the conductive members providing sliding electrical couplings with the electrical contacts by physically slidingly engaging the sliding window electrical contacts through the entire movement range of the sliding window between the open and closed positions for providing current to the first heater grid and providing current to the second heater grid.

2. The heated sliding window assembly of claim 1 wherein the first heater grid and the second heater grid are connected in series.

3. The heated sliding window assembly of claim 1 including a frame the rail and the at least one fixed window attached to the frame.

4. The heated sliding window assembly of claim 1 including a guide bracket positioned in a channel formed in the rail, the guide bracket having a slot formed therein, the slot receiving the sliding window.

5. The heated sliding window assembly of claim 1 wherein the conductive members comprise a pair of spaced apart metal strips.

6. The heated sliding window assembly of claim 5 wherein the electrical contacts comprise a pair of leads attached to the sliding window, the pair of leads aligned with and contacting the pair of spaced apart metal strips.

7. The heated sliding window assembly of claim 6 wherein the pair of leads are electrically connected to the first heater grid.

8. The heated sliding window assembly of claim 7 wherein the pair of spaced apart metal strips are electrically connected to the second heater grid.

9. The heated sliding window assembly of claim 1 including a cover attached to the sliding window and protecting the electrical contacts.

10. A heated sliding window assembly comprising:

at least one fixed window positioned on a back of a vehicle;

a sliding window positioned on the back of the vehicle, the sliding window moveable relative to the fixed window between open and closed positions, the sliding window including a first heater grid directly attached to a glass of the sliding window;

the at least one fixed window includes a second heater grid attached thereto;

electrically conductive members mounted on the at least one fixed window, the conductive members slidingly electrically physically coupling to attached to the sliding window by physically slidingly engaging the electrical contacts through the entire movement range of the sliding window between the open and closed positions for providing current to the first heater grid and providing current to the second heater grid.

11. The heated sliding window assembly of claim 10 wherein the first heater grid and the second heater grid are connected in series.

12. The heated sliding window assembly of claim 11 wherein the conductive members comprise a pair of spaced apart metal strips.

13. The heated sliding window assembly of claim 12 wherein the electrical contacts comprise a pair of leads attached to the sliding window, the pair of leads aligned with and contacting the pair of spaced apart metal strips.

14. The heated sliding window assembly of claim 13 wherein the pair of leads are electrically connected to the first heater grid and wherein the pair of spaced apart metal strips are electrically connected to the second heater grid.

15. The heated sliding window assembly of claim 13 including a cover attached to the sliding window and protecting the electrical contacts.

16. A heated sliding window assembly comprising:

at least one fixed window positioned on a back of a vehicle;

a sliding window positioned on the back of the vehicle, the sliding window moveable relative to the fixed window, the sliding window moveable between open and closed positions, the sliding window including a first heater grid directly attached to a glass of the sliding window;

the at least one fixed window including a second heater grid directly attached to a glass of the at least one fixed window;

electrically conductive members mounted on the at least one fixed window, the conductive members physically coupled to sliding window electrical contacts attached to the sliding window, the conductive members slidingly electrically coupling the sliding window and the at least one fixed window by physically slidingly engaging the electrical contacts through the entire movement range of the sliding window between the open and closed positions for providing current to the first heater grid and the second heater grid.

* * * * *